US007578017B2

(12) United States Patent
Decouvelaere

(10) Patent No.: US 7,578,017 B2
(45) Date of Patent: Aug. 25, 2009

(54) METHOD OF RENDERING A FABRIC ELASTIC BY MEANS OF CAUSTIC TREATMENT AND RELAXATION MACHINE FOR PERFORMING SAID METHOD AND FABRIC THUS OBTAINED

(75) Inventor: Patrick Decouvelaere, Docelles (FR)

(73) Assignee: SARL P.A.T., Lepanges sur Vologne (FR)

( * ) Notice: Subject to any disclaimer, the term of this patent is extended or adjusted under 35 U.S.C. 154(b) by 173 days.

(21) Appl. No.: 10/565,458

(22) PCT Filed: Jul. 23, 2004

(86) PCT No.: PCT/FR2004/001973

§ 371 (c)(1),
(2), (4) Date: Jan. 20, 2006

(87) PCT Pub. No.: WO2005/019516

PCT Pub. Date: Mar. 3, 2005

(65) Prior Publication Data

US 2006/0174419 A1 Aug. 10, 2006

(30) Foreign Application Priority Data

Jul. 25, 2003 (FR) ..... 03 09271

(51) Int. Cl.
*D06B 3/10* (2006.01)

(52) U.S. Cl. ..... 8/151; 8/158; 68/11

(58) Field of Classification Search ..... 8/151.1; 68/205 R, 11
See application file for complete search history.

(56) References Cited

U.S. PATENT DOCUMENTS 3,056,645 A * 10/1962 Anderson et al. ..... 8/109
3,528,763 A * 9/1970 Runton ..... 8/125
4,426,203 A * 1/1984 Abel et al. ..... 8/138

FOREIGN PATENT DOCUMENTS

DE 2 300 724 * 7/1974
GB 2316690 3/1998

* cited by examiner

*Primary Examiner*—Frankie L Stinson
(74) *Attorney, Agent, or Firm*—Gary M. Cohen

(57) ABSTRACT

A method of treating fabrics, such as de-sized and/or previously bleached hydrophilic fabrics, having threads in a selected machine direction (a weft, or inversely, a warp) and formed of natural or artificial cellulose fibers. The fabric is impregnated with a metal peroxide while leaving the fabric free in the selected machine direction for a period of time necessary for swelling of the fibers of the threads in the selected machine direction and for modification of the cellulose. The fabric is then passed in air while leaving the fabric relaxed and without tension in the selected machine direction, during which the threads in the selected machine direction swell and assume the form of a spring, after shrinkage, followed by at least one rinsing, at least one washing, and at least one squeezing step. Also, the elastic fabrics obtained by the method, and the machine for implementing the method.

18 Claims, 5 Drawing Sheets

METHOD OF RENDERING A FABRIC ELASTIC BY MEANS OF CAUSTIC TREATMENT AND RELAXATION MACHINE FOR PERFORMING SAID METHOD AND FABRIC THUS OBTAINED

BACKGROUND OF THE INVENTION

The present invention relates to a novel method for rendering a fabric elastic, a machine for implementing the method, and the fabric obtained by the method.

More particularly, a solution has been found to a problem not yet solved; giving a characteristic of elasticity to a fabric produced with fibers that are naturally non-elastic before treatment.

SUMMARY OF THE INVENTION

This solution involves a method for mechanically and chemically treating a fabric by impregnation with caustic soda, or with another metal peroxide. The method includes application of the metal peroxide to a hydrophilic fabric, for example a de-sized fabric and/or a previously bleached fabric, having threads oriented in a selected fabric direction, including a weft, or inversely, a warp, which threads are made of natural or artificial cellulose fibers. During impregnation with the metal peroxide, the weft (or inversely the warp) of the fabric is left free for a period of time necessary for swelling of the fibers constituting the weft (or inversely the warp) of the fabric and for modification of the cellulose forming the fibers of the fabric. The fabric is then subjected to at least one relaxation with no weft tension (or inversely, with no warp tension), by passage in air, during which the weft (or inversely the warp) swells and then assumes a spring shape, after shrinkage, at least one rinsing, at least one washing, and at least one squeezing.

More particularly, and as a nonlimiting example, the fabric is placed in alkaline contact at 14 to 250 Baumé for a time less than 5 minutes.

Following impregnation, the treatment method of the present invention preferably includes at least a first vigorous squeezing, for example, with a driving off rate of at least 70% of the product, followed by a first relaxation passage in air, for example, for at least one minute.

Preferably, the fabric to be treated has a weft (or inversely a warp) comprised of cellulose-based fibers, and a construction which allows swelling of the weft (for example, by about 30% to 50%) and a strong squeezing.

Also provided is a machine for implementing the foregoing method, which principally and successively includes an impregnation station, and at least a first squeezing station and a first relaxation station. The machine can further be optionally and successively provided with a direction-changing roller, a second squeezing station, a second relaxation station, a rinsing station, one or two washing stations, a final squeezing station, and a rolling-up station. The machine can further include means for regulating the speed of progress of the fabric through the machine, for managing the duration of the impregnation with caustic soda and the duration of the relaxation in air.

The fabric obtained is a cellulose-based elastic fabric whose weft (or inversely whose warp) is comprised of cellulose fibers that were not naturally elastic before application of the treatment method of the present invention and that have elastic properties in the weft direction (or inversely, in the warp direction) which are conferred upon the fabric by the treatment method of the present invention. The warp (or inversely the weft) can be made of other materials, but must be able to withstand the peroxide treatment. By way of example, certain synthetic materials, such as polyester, can be used for this.

Further discussion of the present invention is provided in the description given below, with reference to the following illustrations.

DETAILED DESCRIPTION OF PREFERRED EMBODIMENTS

For purposes of simplifying the description which follows, which is given by way of example, a method and a machine provided in accordance with the present invention is described which makes it possible to render a fabric elastic in the weft direction. The method and the machine of the present invention can similarly be used to obtain elasticity in the warp direction. For this, however, it would be necessary to invert the principle of the method and operations of the machine described hereafter. Also to be noted is that, as is conventional, the rates given below for the squeezing operations to be described are "driving off" rates.

Figure 1:
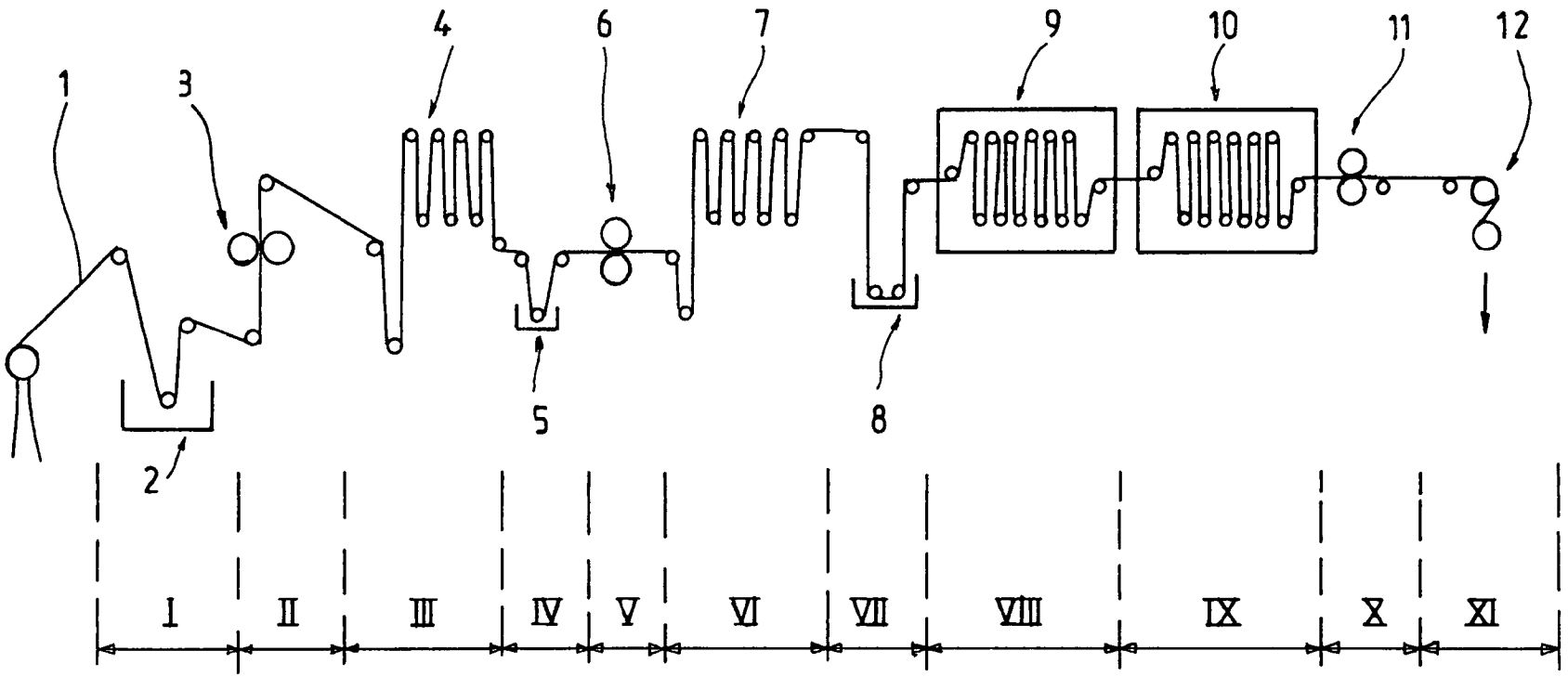
FIG. 1 is a schematic representation of the method of the present invention.

FIG. 1 shows a preferred embodiment method which is provided in accordance with the present invention, and which is given as a nonlimiting example. In this example, a fabric (1), such as a hydrophilic fabric and/or a previously bleached fabric, is first impregnated (in the Region I) with caustic soda in a bath (2) while leaving the fabric free (without weft tension), in this way allowing the weft to swell by impregnation and to become modified. Other metal peroxides are also suitable for this, and the treatment can be suitable for non-bleached but hydrophilic fabrics such as, for example, a de-sized fabric. The rate of feed of the fabric is regulated in such a way that a predetermined duration of impregnation is provided which is sufficient for a maximum swelling of the weft to occur, while remaining below a threshold of transformation and/or of fixing and/or of deterioration of the fibers.

After exiting from the bath (2) of caustic soda, the fabric undergoes a partial squeezing (in the Region II) in a conventional device used for such purposes, such as a squeezing mangle (3). By way of example, a strong squeezing is carried out, with a driving off rate of at least 70%. Other driving off rates are possible, but the squeezing must be strong in order to give shape to the cellulose thread.

The fabric then undergoes relaxation (in the Region III). For this to happen, the fabric is taken into a station (4), for relaxation over a series of rollers. The length of travel of the fabric in free air occurs in zig-zag fashion, between the rollers, and is predetermined and sufficient for the weft of the fabric to assume its shape and its shrinkage under the action of the caustic soda.

The fabric then passes through a tub (in the Region IV) having a direction changing roller (5). The tub can be empty, or filled with caustic soda, depending on the characteristics of the fabric (material, weave, weight). Following this, the fabric undergoes a second squeezing (in the Region V) in a squeezing mangle (6), followed by a second relaxation (in the Region VI) without weft tension. This serves to perfect the shrinkage in the width of the fabric and its "spring effect" which gives the fabric its elasticity.

The fabric can then optionally undergo a cold rinsing (in the Region VII) in a tank (8), and at least one or two washings (in the Regions VIII and IX) in overflowing water tanks (9, 10).

The fabric passes through the relaxation stations (4) and (7) without weft tension, but with warp tension, and for a period of time that is sufficient to allow the weft to shrink. This period of time is predetermined according to the characteristics of the fibers and of the fabric.

Following its output, the fabric has acquired a "spring" effect, or elastic effect memory. After a final squeezing (in the Region X) in rollers (11), the fabric is wound (in the Region XI) onto a cylinder (12). The fabric can then undergo treatments such as hot washing and/or neutralization of the caustic soda in an acid bath, and normal finishing treatments such as dyeing, drying, stiffening and Tumbler drying to release tensions, etc. It can be important to finish the treatment of the fabric with a passage in a Tumbler machine in order to obtain good elasticity, excellent stability and a good feel. The fabric then assumes a state of equilibrium.

The following is provided as an illustration of the characteristics of a preferred but nonlimiting example of a fabric produced in accordance with the above-described method. The fabric had a linen warp, a Tencel® weft, and a square weave, and was of rather loose construction to allow the weft to swell sufficiently, for example, by about 30%. Such a construction can be calculated according to a mathematical model.

The fabric was then impregnated in a caustic soda bath at 14 to 250 Baumé for less than 5 minutes, for example, from 3 to 4 minutes. A first squeezing was vigorous, for example, at least 70%, followed by a first relaxation in air. A second squeezing was also vigorous, for example, at least 70%, followed by a second relaxation in air. This was then followed by rinsings and washings in water (for example, in cold water at about 10 m per minute), a final vigorous squeezing (for example, at least 80%), and neutralization of the caustic soda and hot water washing.

Tests on the fabric obtained showed an elasticity on the order of 15 to 25%. The fabric obtained exhibited good behavior in use because it improves with the number of washings in the user's home and is not sensitive to the temperature of the water.

The method of the present invention applies more generally to all fabrics whose weft (or inversely whose warp) is comprised of natural cellulose fibers such as, for example, fabrics made of linen or artificial fibers such as, for example, Tencel® or Lyocell®. The warp (or inversely the weft) can be comprised of natural, artificial or synthetic fibers.

The present invention also pertains to a machine which is specifically designed to implement the above-described method. Such a machine principally and successively includes an impregnation station (2), and at least a first squeezing station (3) and a first relaxation station (4).

Such a machine can further be optionally and successively provided with the following. A tank or bucket (5) can be provided, for use empty or with the addition of peroxide, which can have a direction-changing roller for preventing folds upon entry to the next station. Filling the bucket (5) makes it possible to reduce the passage time through the tank or bucket (5). A second squeezing station (6) can be provided to improve the effectiveness of the first squeezing station (3), followed by a second relaxation station (7). A rinsing station (8) can be provided to neutralize the fabric in a washer after passage through the machine. One or two washing stations (or compartments) (9) (10), a final squeezing station (11), and a rolling-up station (12) can also be provided.

Such a machine can further include means for regulating the speed of progress and the warp tension in accordance with the durations necessary for impregnation and for relaxations of the weft in air. The machine can also include all of the functional controls necessary for its operation which are otherwise known to those skilled in the art.

Such a machine makes it possible to obtain elasticity in the weft direction, that is to say, in the width of the fabric. Throughout the treatment, the warp is tensed, which causes the weft (which remains free) to undulate, and becomes fixed in an undulated state. There is a crushing of the weft threads between the warp threads and/or at the warp and weft junction, which remains in memory over the fabric after processing.

The improvements of the present invention, as previously described, exhibit the following advantages. In particular, the method allows the development of a mathematical model which is capable of predicting the characteristics of the fabric after treatment according to the constriction of the fabric, the weave, the mixture, the width, the elasticity, the sought weight, etc. As a result, the parameters for the treatment can be defined according to a previously studied and/or calculated fabric model.

A large number of natural or artificial cellulose fibers are suitable for use. It is necessary to adapt the concentration of the caustic soda, or of the metal peroxide, to the type of cellulose used. However, a natural cellulose fiber such as linen or an artificial fiber such as Lyocell® (the Tencel® brand, for example) are perfectly adapted to the treatment method of the present invention. On Lyocell® fibers, the treatment partially transforms the crystalline nature of the cellulose into amorphous cellulose.

The warp and weft stability, upon washing of the fabric obtained, is very greatly improved and sanforizing is not necessary after dyeing. The shape memory fixes the fabric and a relationship gives rise to a mechanical stability of the fabric. The feel is improved. The elasticity is not sensitive to the temperature of water, up to 100° C. The fabric fractures less during dyeing, which reduces defects, and the fabric fractures less on washing, which facilitates ironing. With Lyocell®, there is a great reduction in fibrillation during the treatment (dyeing, stiffening), which improves the appearance of the surface of the fabric. The fabric can still be fibrillated, using enzymes. The fabric can be modeled and the industrial process is reliable and reproducible, and it is not necessary to heat fix the fabric, as for elasthanne®, which is a great advantage for obtaining well blued whites, which become yellow with heat.

Furthermore, a fabric produced in accordance with the present invention can be identified, on the one hand, by its straight and tensed warp (or inversely its weft), whereas the weft is undulated and has been locked or fixed in a spring state by a crushing at the junction of the weft fibers and the warp fibers, at the time of the shrinkage. On the other hand, a fabric produced in accordance with the present invention can be identified by an at least partial transformation of fibers of the crystalline type into amorphous cellulose.

It is also noted that a fabric produced in accordance with the present invention can be identified by its weft and by its warp, in comparison with a fabric not having undergone such a treatment. For example, the weft thread (or inversely the warp thread) of the fabric is less pilous, less round, more flattened, and more crushed. It is in the shape of a fine ribbon, or a fine strip, and has increased brightness under the microscope. The weft (or inversely the warp) assumes a very marked and very visible undulation. Its shape perfectly takes account of the weave of the fabric, and it memorizes a spring state with greater crushing in the space between two warp threads. The weft (or inversely the warp) assumes elasticity according to the construction and a good return force provided the elastic limit is not exceeded. Its ability to withstand torsion is much greater than for a non-treated weft due to shape memory. In the case of an open-end thread, the fagoting of the fibers after treatment reveals, under the microscope, a tendency to create rings around the thread. Moreover, the warp (or inversely the weft) thread is straighter and less undulated, with weaker flattening than on a conventional fabric. It is much less flattened than the weft and exhibits less marked undulation. Its elasticity is weak on cellulose.

Whatever cellulose is used, the treatment of the present invention changes the proportion of the percentages of cellulose I, of cellulose II (both crystalline), and of amorphous cellulose. The treatment renders the new structure of the cellulose irreversible and makes it possible to obtain good overall mechanical equilibrium.

Figure 2:
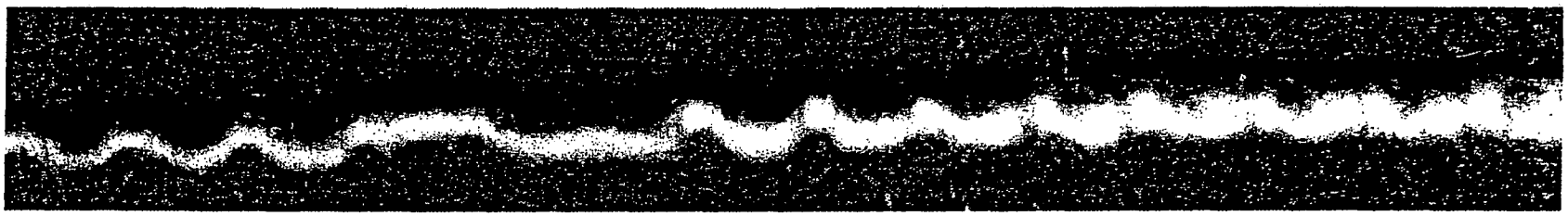
FIGS. 2, 3 and 4 are enlarged views of illustrative threads, based on cellulose fibers, which have undergone a treatment in accordance with the present invention.
Figure 3:
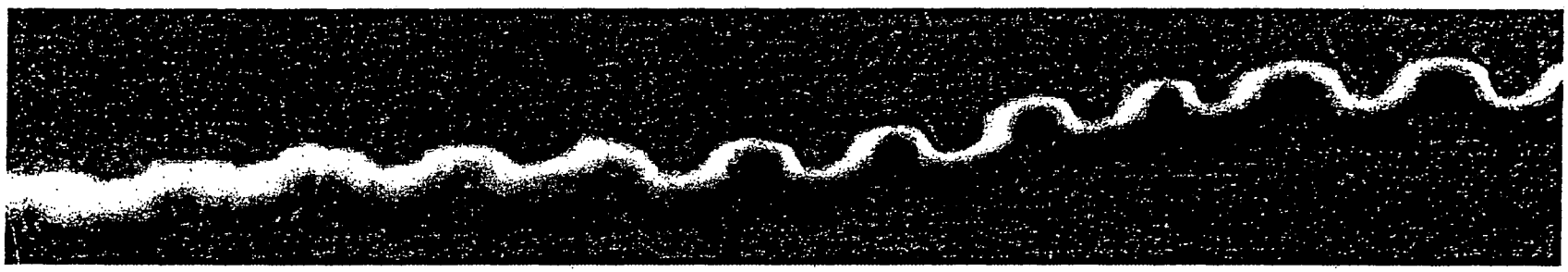
Figure 4:
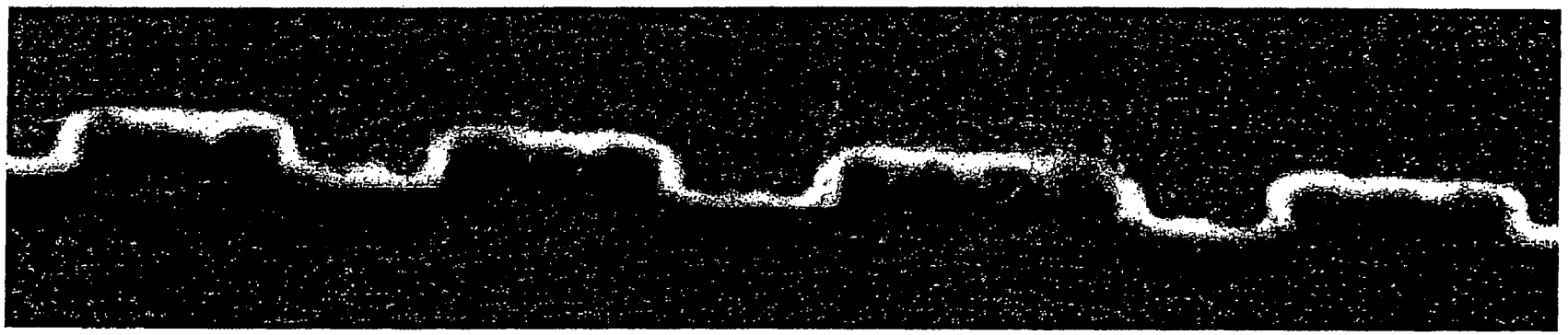
Figure 5:
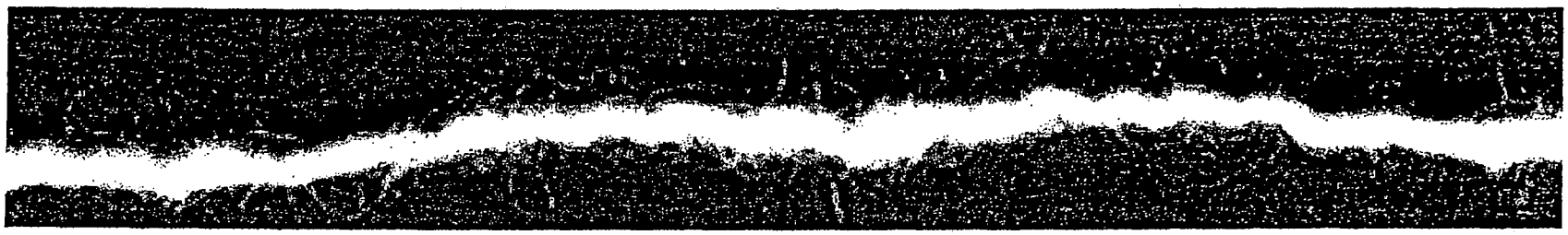
FIG. 5 is an enlarged view of a thread, based on cellulose fibers, which has not undergone a treatment in accordance with the present invention.

FIGS. 2, 3 and 4 show the appearance of a weft (or inversely a warp) thread, of different weaves, treated by the method of the present invention. The illustrated threads take advantage of shape memory by the flattened structure of the thread, by its crushing at the points of contact, and by the undulations related to the weave. For example, FIG. 2 shows an irregular weave. The undulation is marked and the weft twists. FIG. 3 shows a regular weave with small loose threads (or passages). FIG. 4 shows a regular weave with large loose threads, which takes good advantage of the crushing caused by the warp (or inversely by the weft). FIG. 5 shows a non-elastic thread based on cellulose fibers taken from a fabric not treated by the method of the present invention, and which will assume a characteristic of elasticity after treatment.

A fabric produced in accordance with the present invention is, therefore, a fabric that is not naturally elastic. Elasticity in the weft direction (or inversely, in the warp direction) is conferred upon the fabric by chemical and mechanical treatment which modifies the cellulose of the thread constituting the weft (or inversely the warp) in order to give the thread a shape memory, the memorized shape being due to the impression of the weave of the fabric during shrinkage. After treatment, the warp (or inversely the weft) is straight and tensed, while the weft is undulated according to a shape or impression depending on the weave of the fabric.

When used in the foregoing description, it is to be understood that the expression "not naturally elastic" signifies that the fabric and/or the thread, in the absence of any treatment, does not have any characteristic of elasticity and, in particular, that the fabric does not comprise threads which are elastic or rendered elastic by manufacture (for example, a wound thread or a thread with an elastic core).

The invention claimed is:

1. A method for treating a fabric, including de-sized fabrics and previously bleached hydrophilic fabrics, wherein the fabric includes threads oriented in a first fabric direction and threads oriented in a second fabric direction crossing the first fabric direction, wherein the threads oriented in the first fabric direction are made of natural or artificial cellulose fibers, and wherein the method comprises the steps of:

applying a metal peroxide to the fabric so that the fabric is impregnated with the metal peroxide, while leaving the fabric free and without tension in the first fabric direction and while placing the fabric under tension in the second fabric direction, for a period of time necessary for swelling of the fibers oriented in the first fabric direction and for modification of the fibers;

passing the impregnated fabric in air, while leaving the fabric relaxed and without tension in the first fabric direction and while placing the fabric under tension in the second fabric direction, swelling the threads oriented in the first fabric direction and causing the threads to assume a spring shape, after shrinkage, at least one rinsing of the fabric;

at least one washing of the fabric; and at least one squeezing of the fabric.

2. The method of claim 1 wherein the first fabric direction is a weft or a warp.

3. The method of claim 1 wherein the metal peroxide is caustic soda at 14 to 25° Baumé.

4. The method of claim 3 wherein the metal peroxide is in alkaline contact with the fabric for a period of time less than 5 minutes.

5. The method of claim 1 which, following the impregnation, further includes at least one vigorous squeezing of the fabric, followed by the relaxation of the fabric passing in air.

6. The method of claim 1 wherein the threads oriented in the first fabric direction are formed of artificial fibers.

7. The method of claim 6 wherein the threads oriented in the first fabric direction are formed of Tencel®.

8. The method of claim 1 wherein the threads oriented in the first fabric direction are formed of natural fibers.

9. The method of claim 8 wherein the threads oriented in the first fabric direction are formed of linen.

10. The method of claim 1 wherein the fabric has a construction that allows the threads oriented in the first fabric direction to swell.

11. A machine for treating a fabric using the treatment method of claim 1 and which successively comprises:

an impregnation station including a tank containing a metal peroxide;

at least a first squeezing station;

at least a first relaxation station;

at least one washing station;

a final squeezing station;

a rolling-up station; and controls for regulating a speed of progress of the fabric through the machine, for managing the duration of the impregnation with caustic soda and the duration of the relaxation in air.

12. The machine of claim 11 which further includes a direction-changing roller following the first relaxation station.

13. The machine of claim 12 wherein the direction-changing roller is located in a tank containing the metal peroxide.

14. The machine of claim 11 which further includes a second squeezing station following the first relaxation station.

15. The machine of claim 14 which further includes a second relaxation station following the second squeezing station.

16. The machine of claim 15 which further includes a rinsing station following the second relaxation station.

17. The machine of claim 11 wherein the fabric has threads in a first fabric direction which are comprised of cellulose fibers that are not naturally elastic and threads in a second fabric direction crossing the first fabric direction, and wherein the impregnation station leaves the fabric free and without tension in the first fabric direction and places the fabric under tension in the second fabric direction.

18. The machine of claim 17 wherein the relaxation station leaves the fabric free and without tension in the first fabric direction and places the fabric under tension in the second fabric direction.

* * * * *